United States Patent [19]

Ishizuka

[11] 4,394,110

[45] Jul. 19, 1983

[54] SWASH-PLATE TYPE COMPRESSOR

[75] Inventor: Yutaka Ishizuka, Konan, Japan

[73] Assignee: Diesel Kiki Co., Ltd., Tokyo, Japan

[21] Appl. No.: 212,496

[22] Filed: Dec. 3, 1980

[30] Foreign Application Priority Data

Dec. 13, 1979 [JP] Japan ..... 54-172525

[51] Int. Cl.[3] ..... F04B 1/18; F04B 39/02

[52] U.S. Cl. ..... 417/269; 92/71

[58] Field of Search ..... 417/269; 91/502; 92/71

[56] References Cited

U.S. PATENT DOCUMENTS

| | | | |
|---|---|---|---|
| 4,226,572 | 10/1980 | Nakayama | 417/269 |
| 4,260,337 | 4/1981 | Nomura | 417/269 |
| 4,299,543 | 11/1981 | Shibuya | 417/269 |

FOREIGN PATENT DOCUMENTS

| | | | |
|---|---|---|---|
| 55-117086 | 9/1980 | Japan | 417/269 |
| 2038950 | 12/1978 | United Kingdom | 417/269 |

*Primary Examiner*—William L. Freeh

*Attorney, Agent, or Firm*—Frishauf, Holtz, Goodman & Woodward

[57] ABSTRACT

A swash-plate type compressor is provided which includes a horizontally disposed cylinder block. The cylinder block has three cylinder bores axially extending through the cylinder block in a circumferentially spaced arrangement, two of the cylinder bores being located at upper portions of the cylinder block, while one of them being located at a lower portion thereof, three spaces opening in each end face of the cylinder block and each arranged between adjacent ones of the cylinder bores, one of the spaces being located at an upper portion of the cylinder block, while two of them being located at lower portions thereof, and a swash plate chamber formed at a central portion of the cylinder block. The two spaces located at the lower portions of the cylinder block communicate with the swash plate chamber and serve as an oil reservoir for storing lubricating oil in cooperation with the swash plate chamber.

The one space located at the upper portion of the cylinder block is divided by an axially extending vertical partition wall into a high pressure medium chamber and a low pressure medium chamber, which are used as passages for compression medium.

5 Claims, 9 Drawing Figures

SWASH-PLATE TYPE COMPRESSOR

BACKGROUND OF THE INVENTION

This invention relates to swash-plate type compressors which are adapted for use in air conditioning systems for automotive vehicles or the like, and more particularly to a compressor of such type which has a lubricating oil reservoir having an increased volume.

A conventional swash-plate type compressor generally used in air conditioning systems for automotive vehicles and the like systems comprises a cylinder block formed of at least one piece, a drive shaft extending through the cylinder block along its axis and rotatable relative to the cylinder block, and a swash plate secured on the drive shaft. The cylinder block has three cylinder bores which each have a piston slidably received therein and which axially extend through the cylinder block in an arrangement circumferentially spaced from each other, three spaces opening in each end face of the cylinder block and each arranged between adjacent ones of the cylinder bores, and a swash plate chamber formed at a central portion of the cylinder block. The pistons received within the cylinder bores are arranged in engagement with the swash plate arranged within the swash plate chamber and are reciprocatingly moved within the cylinder bores by the rotation of the swash plate which is caused by the rotation of the drive shaft, to carry out compression actions. The compressor is so disposed that the three cylinder bores are in an array of equilateral triangle with the diametric center of each cylinder bore taken as each vertex of the equilateral triangle, while the three spaces are in an array of inverted triangle with the diametric center of each space taken as each vertex of the inverted triangle. The lower one of the three spaces in the array of inverted triangle and a lower portion of the swash plate chamber form an oil reservoir in which lubricating oil is stored.

The lubricating oil stored in the oil reservoir is splashed upwardly by the swash plate during its rotation into oily mist, which is partly supplied to the portions of engagement of the swash plate with the pistons to lubricate same, and partly led into lower pressure chambers (suction chambers) communicating with the cylinder bores due to a difference in pressure between the swash plate chamber and the lower pressure chambers which is produced by the reciprocating motions of the pistons, the oil which is led into the lower pressure chambers, lubricating radial bearings supporting the drive shaft at locations between the swash plate chamber and the lower pressure chambers. The lubricating oil thus led into the lower pressure chambers are sucked into the cylinder bores together with compression medium and leaked into the refrigerating circuit outside the compressor. When the amount of lubricating oil thus leaked is large or the amount of lubricating oil which is returned from the refrigerating circuit to the compressor is small, the amount of lubricating oil which is stored in the oil reservoir within the compressor becomes insufficient, providing the possibility of seizure of the portions of engagement of the swash plate with the pistons or other portions of the compressor.

Particularly in the conventional compressor of the above arrangement, the oil reservoir which is formed of part of the swash plate chamber and only one of the three spaces has a limited oil storing volume. Therefore, the possibility of seizure of the above-mentioned portions is very large.

OBJECTS AND SUMMARY OF THE INVENTION

It is therefore a primary object of the invention to provide a swash-plate type compressor in which two of the three spaces formed between the three cylinder bores at each end portion of the cylinder block are located at lower portions of the cylinder block and used as part of the oil reservoir to thus obtain an increased oil storing space, which makes the compressor free from the above-mentioned seizure.

It is a further object of the invention to provide a swash-plate type compressor in which upper one of the three spaces formed between the three cylinder bores is divided by a partition wall into a high pressure medium chamber and a low pressure medium chamber which are arranged close to each other so that the suction port and the discharge port can be formed integrally with each other and in a compact size to thereby reduce the mounting space for the compressor.

According to the swash-plate type compressor of the invention, the cylinder block has three cylinder bores arranged in relation circumferentially spaced from each other and extending through the cylinder block axially thereof, two of the cylinder bores being located at upper portions of the cylinder block and one being located at a lower portion thereof, three spaces opening in each end face of the cylinder block, each of the spaces being arranged between adjacent ones of the three cylinder bores, one of the spaces being located at an upper portion of the cylinder block and two being located at lower portions thereof, and a swash plate chamber located at a central portion of the cylinder block. The two spaces located at the lower portions of the cylinder block are formed in communication with the swash plate chamber. The two lower spaces and the swash plate chamber form an oil reservoir in which lubricating oil is stored.

The space located at the upper portion of the cylinder block is provided therein with a vertical partition wall extending axially of the space which divides the space into a high pressure medium chamber and a low pressure medium chamber. The high pressure medium chamber is used as a passage for compression medium discharged while the low pressure medium chamber is used as a passage for compression medium being sucked into the cylinder bores.

The above and other objects, features and advantages of the invention will be more apparent from the ensuing detailed description taken in connection with the accompanying drawings, in which:

DETAILED DESCRIPTION

Figure 1:
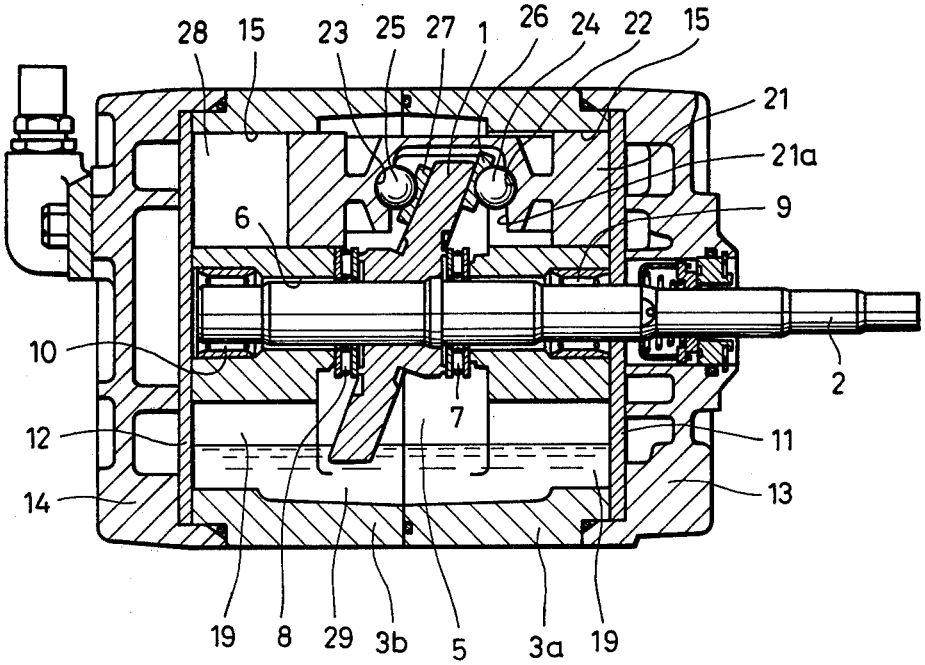
FIG. 1 PRIOR ART
FIG. 1 is a longitudinal sectional view of a conventional swash-plate type compressor.
Figure 2:
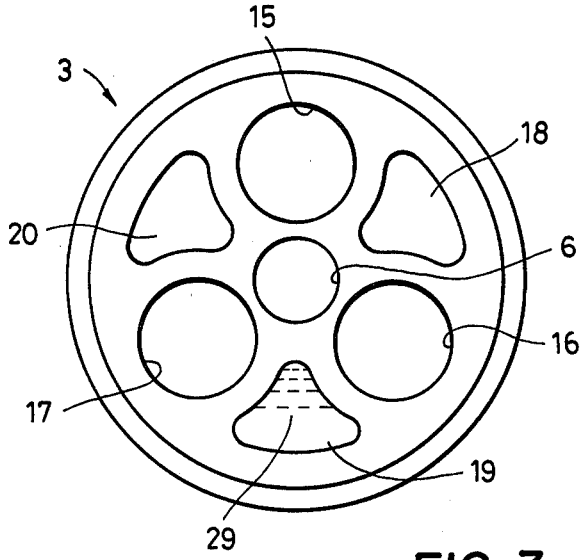
FIG. 2 PRIOR ART
FIG. 2 is an end view of the cylinder block used in the compressor of FIG. 1.

Referring now to the drawings, wherein like reference characters designate like or corresponding parts throughout the several views, FIGS. 1 and 2 illustrate a conventional swash-plate type compressor.

In FIG. 1, a swash plate 1 is rigidly secured on a drive shaft 2 at an inclination thereto, which is arranged within a swash plate chamber 5 which is formed within a cylinder block 3 which comprises two cylindrical pieces 3*a*, 3*b* combined together in axial alignment and horizontally disposed. The drive shaft 2 extends through a central bore 6 formed within the cylinder block 3 along its axis and rotatably supported by thrust bearings 7, 8 and radial bearings 9, 10. A front cylinder head 13 and a rear cylinder head 14 are secured to the opposite ends of the cylinder block 3 with front and rear valve plates 11, 12 intervening therebetween.

As shown in FIG. 2, the constituent pieces 3*a*, 3*b* of the cylinder block 3 are each formed with three cylinder bores 15, 16, 17 which axially extend through the associated piece in an arrangement circumferentially spaced from each other, and three spaces 18, 19, 20 each having a sectorial cross section, which are each arranged between adjacent ones of the cylinder bores 15, 16, 17 and open in an outer end of the associated piece. The cylinder bores 15, 16, 17 are arranged in an array of equilateral triangle with the diametric center of each bore taken as each vertex of the equilateral triangle, while the spaces 18, 19, 20 are arranged in an array of inverted triangle with the diametric center of each space taken as each vertex of the inverted triangle.

A double-acting piston 21 is slidably received within each of the cylinder bores 15, 16, 17 formed through the cylinder block 3 and has a central portion formed with a central recess 21*a* which is disposed to stride over the swash plate 1. The central recess 21*a* formed with ball pockets 22, 23 in which balls 24, 25 are received. Shoes 26, 27 are interposed between the balls 24, 25 and the peripheral fringe of the swash plate 1 to engage the swash plate 1 with the piston 21.

With this arrangement, when the drive shaft 2 is rotated, the swash plate 1 is correspondingly rotated to cause reciprocal motions of the pistons 21 within the respective cylinder bores 15, 16, 17. The reciprocating motions of the pistons 21 cause compression chambers 28 defined between the pistons 21 and the valve plates 11, 12 within the cylinder bores 15, 16, 17 to become expanded and contracted alternately so that suction valves and discharge valves (not shown) provided on the valve plates 11, 12 are opened and closed with appropriate timing to carry out compression actions.

Of the three spaces 18, 19, 20 formed in each constituent piece 3*a*, 3*b* of the cylinder block 3, the spaces 18, 20 which are located at upper portions of the cylinder block are used as passages for allowing compression medium discharged and compression medium being sucked, respectively, to pass therethrough respectively, while the space 19 which is located at a lower portion of the cylinder block communicates with the swash plate chamber 5 and is used as an oil reservoir 29 in cooperation with the chamber 5. The lubricating oil stored in the oil reservoir 29 is splashed upwardly by the rotating swash plate 1 into oily mist which is fed to the portions of the swash plate 1 engaging with the pistons 21 as well as the thrust bearings 7, 8, the radial bearings 9, 10, etc. to lubricate same.

However, in the conventional swash-plate type compressor constructed as described above, the oil reservoir 29 has a limited oil storing volume, since it is formed of the lower portion of the swash plate chamber 5 and only one space 19, thus involving the aforementioned problem of the occurrence of seizure.

Figure 3:
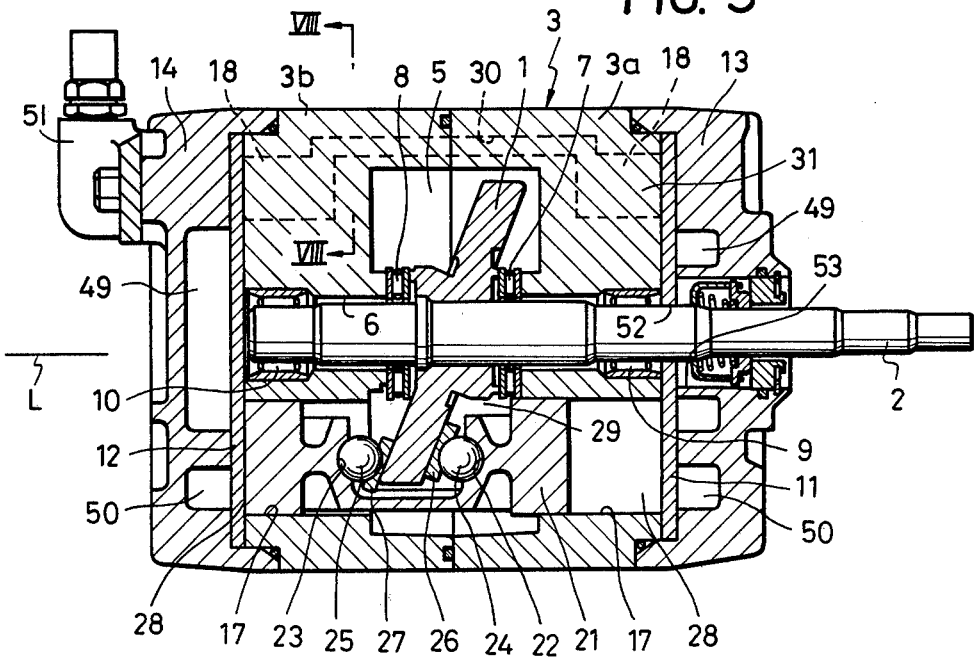
FIG. 3 is a longitudinal sectional view of a swash-plate type compressor according to one embodiment of the invention.
Figure 4:
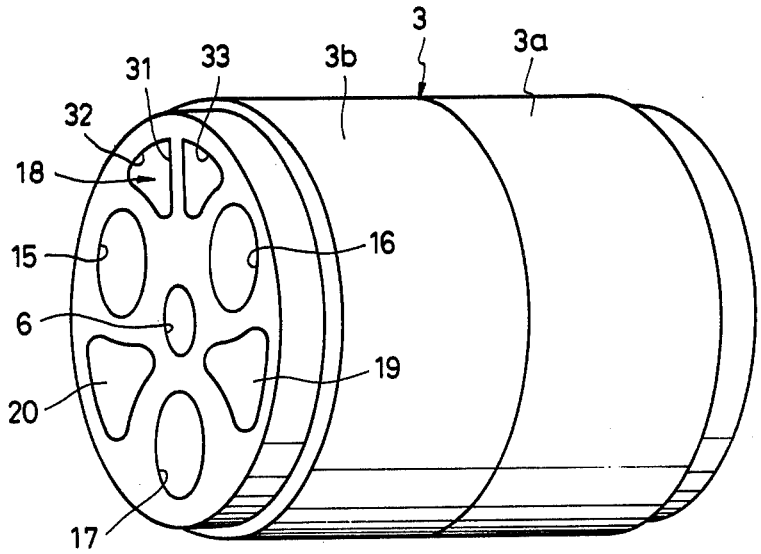
FIG. 4 is a perspective view of the cylinder block used in the compressor of FIG. 3.
Figure 5:
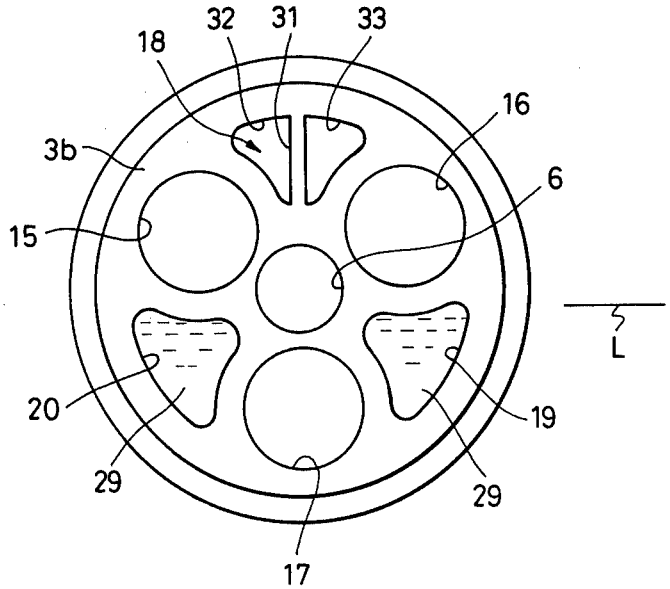
FIG. 5 is an end view of the cylinder block used in the compressor of FIG. 3.

Referring now to FIGS. 3 through 7, a swash-plate type compressor according to an embodiment of the present invention is illustrated. In FIGS. 3 through 5, the cylinder block 3, which comprises two cylindrical pieces 3*a*, 3*b* combined together in axial alignment and horizontally disposed, is formed with a central bore 6 extending axially of the cylinder block in which the drive shaft 2 is inserted. Three cylinder bores 15, 16, 17, are also formed in the cylinder block 3 which axially extend through the cylinder block and arranged at circumferentially equal intervals. A piston 21 is received within each of these cylinder bores. Of these cylinder bores 15, 16, 17, the two bores 15, 16 are located at upper portions of the cylinder block 3, while the other bore 17 is located at a lower portion of the cylinder block 3. That is, as viewed from an end of the cylinder block 3, these cylinder bores 15, 16, 17 are arranged in an array of inverted triangle with the diametric centers of them taken as the respective vertices of the inverted triangle. The constituent pieces 3*a*, 3*b* of the cylinder block 3 are each formed with three spaces 18, 19, 20 each having a sectorial cross section, which are each arranged between adjacent ones of the cylinder bores 15, 16, 17 and open in an outer end face of the respective constituent piece. Thus, the three spaces 18, 19, 20 are arranged at circumferentially equal intervals in an array of equilateral triangle with the diametric centers of the spaces taken as the vertices of the equilateral triangle. Of these spaces 18, 19, 20, the space 18 which is located at an upper portion of the constituent piece 3*a* is formed in communication with the corresponding space 18 formed in the other constituent piece 3*b* by means of a communication bore 30 formed in these pieces 3*a*, 3*b*. The upper space 18 of each of the pieces 3*a*, 3*b* is divided by a vertical partition wall 31 axially extending through cylinder block 3 into two subspaces, one of the subspaces serving as a high pressure medium chamber 32 and the other as a low pressure medium chamber 33, respectively (FIGS. 4, 5 and 8). The partition wall 31 also divides the communication bore into two passages. Since the high pressure medium chamber 32 and low pressure medium chamber 33 of the constituent piece 3*a* are communicated with the corresponding chambers 32, 33 of the constituent piece 3*b* through the communication bore 30, respectively, the high pressure medium chambers 32 and one divided side passage of the bore 30 are used as a passage for high pressure medium, and the low pressure medium chambers 33 and the other passage of the bore 30 as a passage for low pressure medium, respectively.

Figure 9:
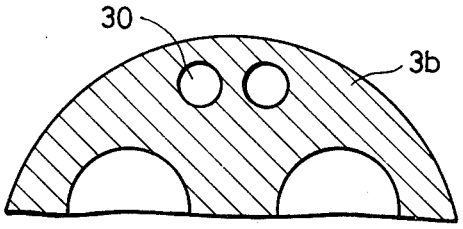
FIG. 9 is a cross sectional part view of a variation of the cylinder block of the compressor according to the present invention.

The communication bore 30 may be formed of two separate bores, instead of being divided by the partition wall 31, as shown in FIG. 9. Further, although in the illustrated embodiment the spaces 18, 18 of the cylinder block constituent pieces 3*a*, 3*b* are in communication with each other through the communication bore 30, alternatively the communication bore 30 may be removed so that the high pressure medium chambers 32, 32 and the low pressure medium chambers 33, 33 may be used merely as chambers in which medium is temporarily stored, as shown in FIG. 9.

Of the spaces 18, 19, 20, the two spaces 19, 20 which are located at lower portions of the cylinder block 3 are in communication with a swash chamber 5 in which the swash plate 1 is arranged and which is formed within the cylinder block 3 at its central portion. These spaces 19, 20 and a lower portion of the swash plate chamber 5 form an oil reservoir 29. Since the oil reservoir 29 is thus formed of the lower portion of the swash plate chamber 5 and the two spaces 19, 20, it has an increased volume as compared with the oil reservoir provided in the conventional swash-plate type compressor, to obtain an increased oil storing capacity. In addition, since the lower spaces 19, 20 are located at right and left locations in a lower portion of each constituent piece 3*a* or 3*b* so that the uppermost portions of the spaces 19, 20 are substantially on the same level with the drive shaft 2, the oil level L in the oil reservoir 29 can be elevated up to the level of the drive shaft 2. Therefore, the thrust bearings 7, 8, the radial bearings 9, 10, the piston 21 received within the lower cylinder bore 17, and the balls 24, 25 and shoes 26, 27 interposed between this piston 21 and the swash plate 1 are wholly or partially submerged in the lubricating oil in the oil reservoir 29, permitting these parts to be directly lubricated, with no need of supplying oily mist thereto which is produced by the rotation of the swash plate 1.

A front cylinder head 13 and a rear cylinder head 14 are rigidly mounted on the opposite ends of the cylinder block 3 with front and rear valve plates 11, 12 intervening, respectively, between the front cylinder head 13 and the cylinder block 3 and between the rear cylinder head 14 and the cylinder block 3.

Figure 6:
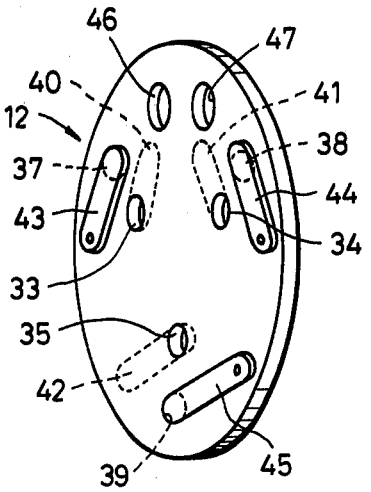
FIG. 6 is a perspective view of the valve plate on the rear side of the compressor of FIG. 3.

Referring now to the valve plates 11, 12, the rear valve plate 12 is illustrated in FIG. 6 which is formed with three suction bores 34, 35, 36 arranged at radially inward locations of the plate 12 and three discharge bores 37, 38, 39 arranged at radially outward locations of same, these locations corresponding to the locations of the cylinder bores 15, 16, 17 of the cylinder block 3. The valve plate 12 has three suction valves 40, 41, 42 mounted on its side surface facing the cylinder block 3 so as to cover the suction bores 34, 35, 36, respectively, and three discharge valves 43, 44, 45 mounted on its other side surface facing the rear cylinder head 14 so as to cover the discharge bores 37, 38, 39, respectively. The valve plate 12 is further formed with two through bores 46, 47 arranged at upper locations of the plate corresponding to the locations of the high pressure medium chamber 32 and low pressure medium chamber 33 of the cylinder block constituent piece 3*b*.

On the other hand, the front valve plate 11 is different in structure from the illustrated rear valve plate 12 only in that a through bore (not shown) is formed therein at its center through which the drive shaft 2 extends.

Figure 7:
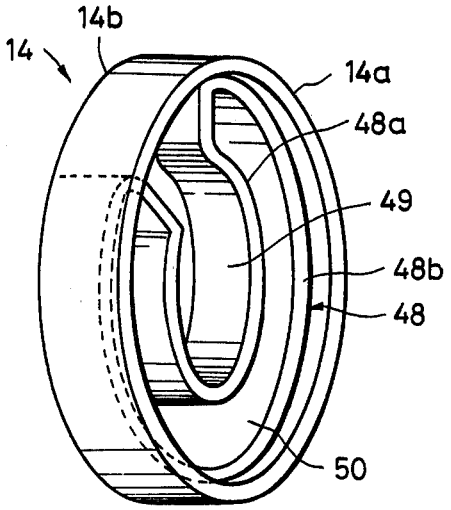
FIG. 7 is a perspective view of the cylinder head on the rear side of the compressor of FIG. 3.
Figure 8:
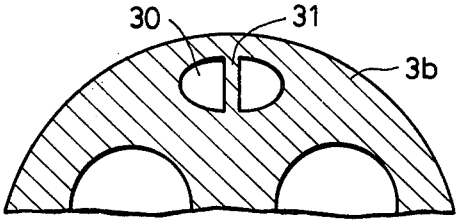
FIG. 8 is a sectional view taken along line VIII—VIII in FIG. 3.
Figure 10:
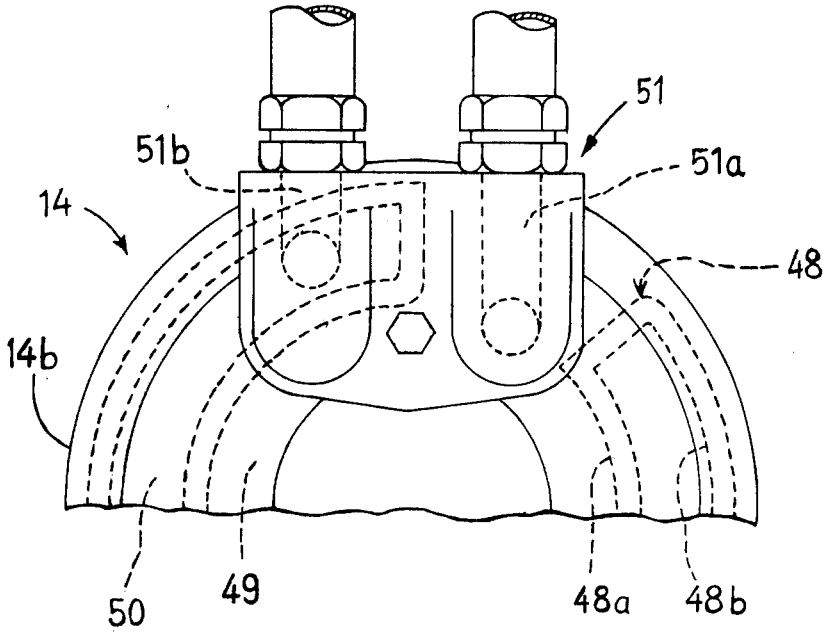
FIG. 10 shows the connector 51 of FIG. 3 in greater detail.

Referring now to the cylinder heads 13, 14, the rear cylinder head 14 is illustrated in FIG. 7 which has a cylindrical body having an interior formed with a rib 48 extending in a double circular shape so as to divide the interior into a suction space and a discharge space. When the cylinder head 14 of such construction is joined at its end 14*a* to the cylinder block constituent piece 3*b* with the valve plate 12 intervening between the two members, a suction chamber 49 is defined between the inner circular wall 48*a* of the rib 48 and an associated end surface of the valve plate 12, which encloses the suction bores 33, 34, 35 and the bore 46, and also a delivery chamber 50 is defined between the outer circular wall 48*b* of the rib 48 and the associated end surface of the valve plate 12, which encloses the discharge bores 37, 38, 39 and the bore 47. A connector 51 (FIGS. 3 and 10) is provided on the outer end 14*b* of the cylinder head 14 at its upper portion, which connector has its interior formed with a suction port 51*a* and a delivery port 51*b* which communicate with the suction chamber 49 and the delivery chamber 50, respectively. The suction port 51*a* and delivery port 51*b* can thus be formed integrally within the single connector 51 which is compact in size, since the high pressure medium chamber 32 and low pressure medium chamber 33 of the cylinder block constituent piece 3*b* are arranged close to each other and also the bores 46 and 47 of the valve plate 12 are correspondingly arranged close to each other.

On the other hand, the front cylinder head 13 is different in structure from the rear cylinder head 14 only in that it is formed with a central through bore 53 (FIG. 3) through which the drive shaft 2 extends, but is not formed with a connector like the above-mentioned connector 51.

With the above arrangement, when the swash plate 1 is rotated within the swash plate chamber 5 in unison with the rotation of the drive shaft 2, the pistons 21 are reciprocatingly moved within the respective cylinder bores 15, 16, 17 so that the compression chambers 28 are expanded or contracted in volume. Accordingly, the suction valves 40, 41, 42 and the discharge valves 43, 44, 45 are opened and closed with appropriate timing in such a manner that at the rear side of the cylinder block 3, compression medium is sucked into the compression chamber 28 on the rear side from the suction chamber 49 in the rear cylinder head 14 through the suction bores 34, 35, 36 of the valve plate 12 and discharged from the compression chambers 28 on the rear side through the discharge bores 37, 38, 39 in the valve plate 12 into the delivery chamber 50 in the rear cylinder head 14, while at the front side of the cylinder block 3, compression medium is sucked into the compression chambers 28 on the front side from the suction chamber 49 in the rear cylinder head 14 through the bore 47 in the valve plate 12, the low pressure medium chambers 33 and communication bore 30 in the cylinder block 3, the suction chamber 49 in the front cylinder head 13 and the suction bores in the valve plate 11 and discharged from the compression chambers 28 on the front side through the discharge ports in the valve plate 11, the delivery chamber 50 in the front cylinder head 13, a bore in the valve plate 11 corresponding to the bore 46 in the valve plate 12, the high pressure medium chambers 32 and communication bore 30 in the cylinder block 3 and the bore 46 in the valve plate 12 into the delivery chamber 50 in the rear cylinder 50 in the rear cylinder head 14, thus carrying out compression actions.

Referring next to the lubrication system of the compressor, the oil level L in the oil reservoir 29 is as high as the drive shaft 2 at its portion within the swash plate chamber 5, with various parts of the compressor below the oil level L always lubricated directly by the oil in the oil reservoir 29, instead of being lubricated by oily mist produced by the splashing action of the rotating swash plate 1. On the other hand, various parts of the compressor above the oil level L are lubricated by oily mist produced by the splashing action of the rotating swash plate 1 or by oil adhering to the swash plate 1 which is deeply submerged at its lower portion in the oil in the oil reservoir 29. As noted above, according to the swash-plate type compressor of the invention, the arrangement that the two lower spaces of the three spaces located between the cylinder bores of the cylinder block are formed in communication with the swash plate chamber to form an oil reservoir provides an increased oil reservoir space having an increased oil storing capacity. Therefore, the maximum allowable amount of lubricating oil that is leaked outside the compressor can be increased. Further, the arrangement that the above-mentioned two spaces forming part of the oil reservoir are located above the lower cylinder bore can elevate the oil level in the oil reservoir. The above two peculiar arrangements provided by the invention make it possible to supply an adequate amount of lubricating oil to various portions of the compressor which require lubricating. Thus, the swash-plate type compressor of the invention can be free from a seizure accident.

The further arrangement that the one upper space of the three spaces formed in the cylinder block is divided by a partition wall into a high pressure medium chamber and a low pressure medium chamber which chambers are used as passages through which compression medium passes. Due to this arrangement, the suction port and delivery port of the compressor can be formed integrally with each other and in a compact size.

While a preferred embodiment has been described, variations thereto will occur to those skilled in the art within the scope of the present inventive concepts which are delineated by the following claims.

What is claimed is:

1. A swash-plate type compressor comprising:

a cylindrical cylinder block having two cylindrical members combined together in axial alignment and horizontally disposed, each of said cylindrical members having an outer end face; a drive shaft extending through said cylinder block along an axis thereof and rotatable relative to said cylinder block; a swash plate secured on said drive shaft; and three pistons arranged within said cylinder block in engagement with said swash plate;

said cylinder block including:

three cylinder bores within which said pistons are slidably disposed, said cylinder bores being formed within said cylindrical members of said cylinder block in circumferentially spaced relation to each other and extending through said cylinder block axially thereof, two of said cylinder bores being located at upper portions of said cylinder block and one being located at a lower portion thereof;

three spaces formed within each one of said cylindrical members of said cylinder block and opening in said outer end face of said each one cylindrical member, each of said spaces being arranged between adjacent ones of said three cylinder bores, one of said spaces being located at an upper portion of said each one cylindrical member and two of said spaces being located at lower portions thereof, said three cylinder bores being arranged in an array of an inverted triangle with the diametric centers of said cylinder bores located at the vertices of said inverted triangle, said three spaces being arranged in an array of a triangle with the diametric centers of said spaces located at the vertices of said triangle;

a chamber located at a central portion of said cylinder block, within which said said swash plate is arranged;

said two spaces located at said two lower portions of said each one cylindrical member being in communication with said swash plate chamber, said two lower spaces and said swash plate chamber forming an oil reservoir in which lubricating oil is stored;

a communication bore communicating said one space located at said upper portion of one of said cylindrical members with said one space located at said upper portion of the other of said cylindrical members; and a vertical partition wall axially extending through said cylinder block, said vertical partition wall dividing said one space located at said upper portion of each of said cylindrical members into a high pressure medium chamber and a low pressure medium chamber, and also dividing said communication bore into two passages;

said high pressure chambers in said cylindrical members being communicated with each other by one of said passages of said communication bore, while said low pressure chambers in said cylindrical members being communicated with each other by the other of said passages of said communication bore, said high pressure medium chambers and said one passage of said communication bore serving as a passage for high pressure medium, and said low pressure medium chambers and said other passage of said communication bore serving as a passage for low pressure medium.

2. The swash-plate type compressor as claimed in claim 1, wherein said three spaces are arranged in an array of equilateral triangle with the diametric centers of said spaces located at the vertices of said equilateral triangle.

3. The swash-plate type compressor as claimed in claim 1 or 2, wherein said two spaces located at said lower portions of said cylinder block have uppermost portions thereof located substantially on the same level with said drive shaft.

4. The swash-plate type compressor as claimed in claim 1 or claim 2, including a pair of cylinder heads mounted on opposite ends of said cylinder block, and a pair of valve plates each intervening between said cylinder block and each of said cylinder heads, each of said cylinder heads and an associated one of said valve plates cooperating with each other to define therebetween a compression medium suction chamber and a compression medium delivery chamber, said valve plates each being formed with a pair of through bores, one of said through bores communicating said compression medium suction chamber with said low pressure medium chamber formed in an associated one of said one spaces in said cylinder block, and the other through bore communicating said compression medium delivery chamber with said high pressure medium chamber formed in an associated one of said one spaces in said cylinder block.

5. The swash-plate type compressor as claimed in claim 4, wherein said two spaces located at said lower portions of said cylinder block have uppermost portions thereof located substantially on the same level with said drive shaft.

* * * * *